United States Patent [19]

Uchimura et al.

[11] Patent Number: 4,618,392

[45] Date of Patent: Oct. 21, 1986

[54] LABEL ADHERING APPARATUS

[75] Inventors: Mitsuo Uchimura; Satoru Uematsu, both of Shizuoka, Japan

[73] Assignee: Tokyo Electric Co., Ltd., Tokyo, Japan

[21] Appl. No.: 486,490

[22] Filed: Apr. 19, 1983

[51] Int. Cl.[4] ..... B65C 9/08; B65C 9/36

[52] U.S. Cl. ..... 156/384; 156/497; 156/571; 156/DIG. 28; 156/DIG. 31; 156/DIG. 39; 156/DIG. 42; 271/107

[58] Field of Search ..... 156/571, 572, 384, 521, 156/DIG. 28, DIG. 29, DIG. 31, DIG. 33, DIG. 42, DIG. 47, 497, DIG. 39; 271/107, 143

[56] References Cited

U.S. PATENT DOCUMENTS

| | | | |
|---|---|---|---|
| 447,907 | 3/1891 | Salomon | 156/571 |
| 1,587,325 | 6/1926 | Johnson et al. | 156/571 |
| 3,546,047 | 12/1970 | Dullinger | 156/568 |
| 3,736,208 | 5/1973 | Kraft et al. | 156/497 |
| 4,025,382 | 5/1977 | Del Rosso | 156/572 |
| 4,355,967 | 10/1982 | Hellmer | 271/107 |

*Primary Examiner*—Michael Wityshyn

*Attorney, Agent, or Firm*—Oblon, Fisher, Spivak, McClelland & Maier

[57] ABSTRACT

This invention is constructed such that a label adhering means for holding and releasing a label is arranged at the other end of an arm with its one end being rotatably held in such a manner as its direction is not varied and that a label adhering may be performed under a stable stepped operative relation between a label issuing position of a label printer and a label adhering position in the adhered object.

16 Claims, 22 Drawing Figures

LABEL ADHERING APPARATUS

BACKGROUND OF THE INVENTION

1. Field of the Invention

This invention relates to a label adhering apparatus in which a label having some requisite items printed thereon is issued and this label is automatically adhered to the corresponding adhered object.

2. Description of the Prior Art

In a conventional type of a label adhering device, there has been proposed such a system in which a label issued by a label printer is suctioned and held by vacuum, conveyed up to an adhering position, then air is blown onto the label to cause the label to be adhered to the object to be labeled under air pressure. However, this prior art system has some disadvantages in that the adhering operation is unpositively performed due to a flying of the label in the air even if it is temporarily held.

OBJECT OF THE INVENTION

It is an object of the present invention to provide a positive movement of a label from a label issuing position to a label adhering position so as to make a stable adhering of the label.

It is another object of the present invention to enable a positive label adhering even if a size of the adhered object is varied and a label adhering position is varied.

It is still further object of the present invention to provide a uniform adhering force over an entire surface of the label as well as a stable adhering even if a plane at the label adhering position is somewhat inclined.

It is yet still further object of the present invention to provide a label adhering means which facilitates a holding of label and its releasing.

DESCRIPTION OF THE PREFERRED EMBODIMENTS

Figure 1:
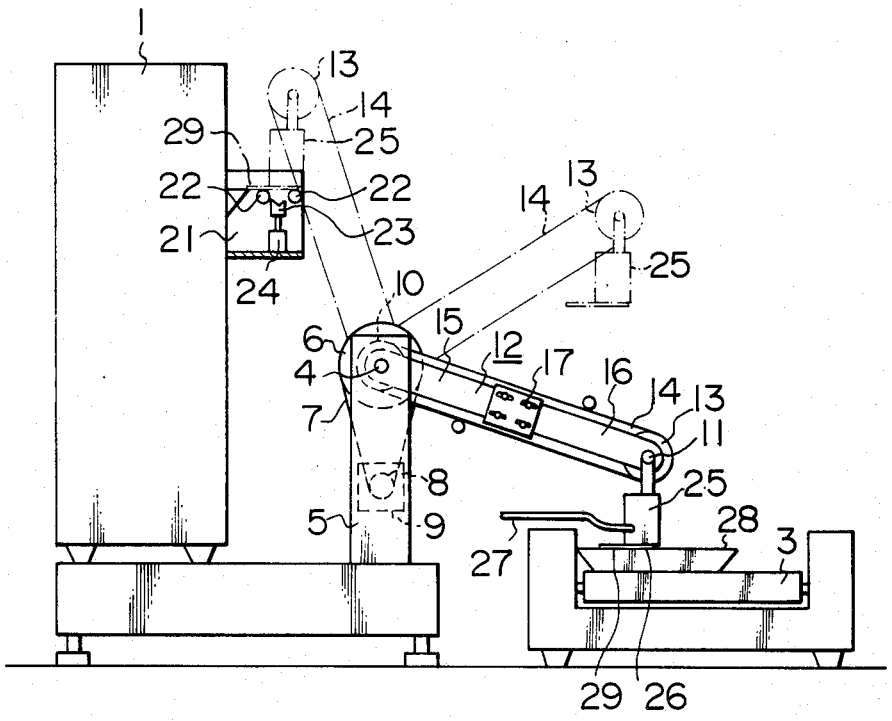
FIG. 1 is a side elevational view for showing one preferred embodiment of the present invention.
Figure 2:
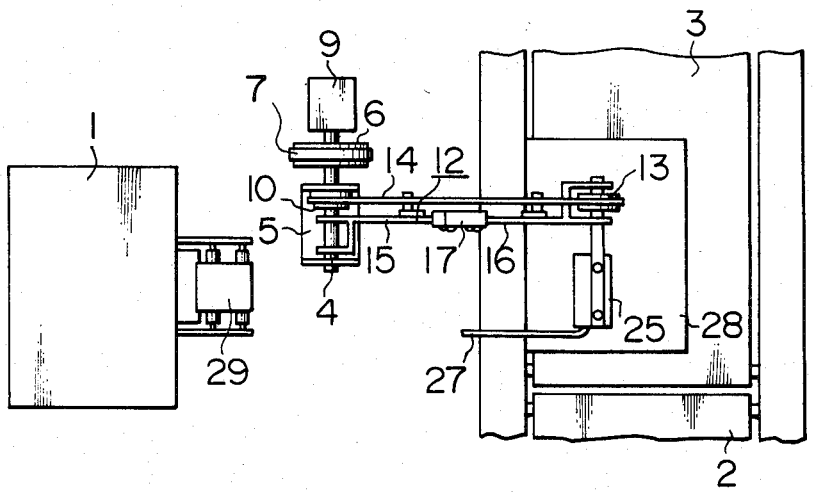
FIG. 2 is a top plan view of the present invention.
Figure 3:
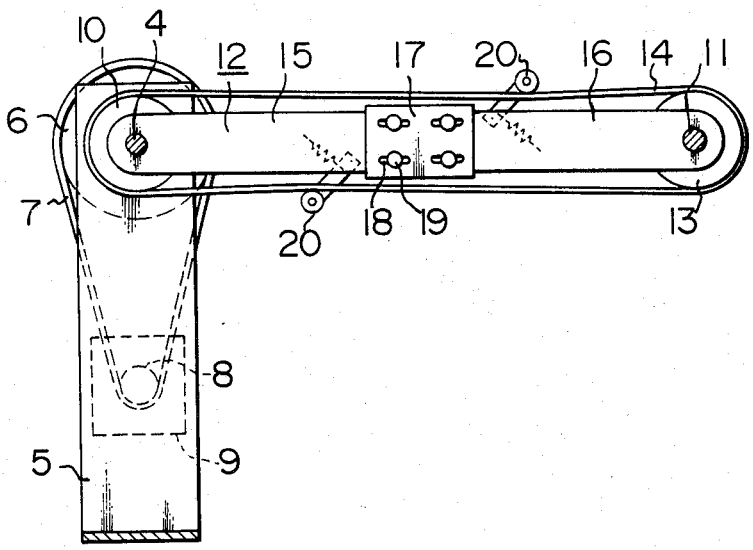
FIG. 3 is a partial enlarged side elevational view for showing an arm driving mechanism.
Figure 4:
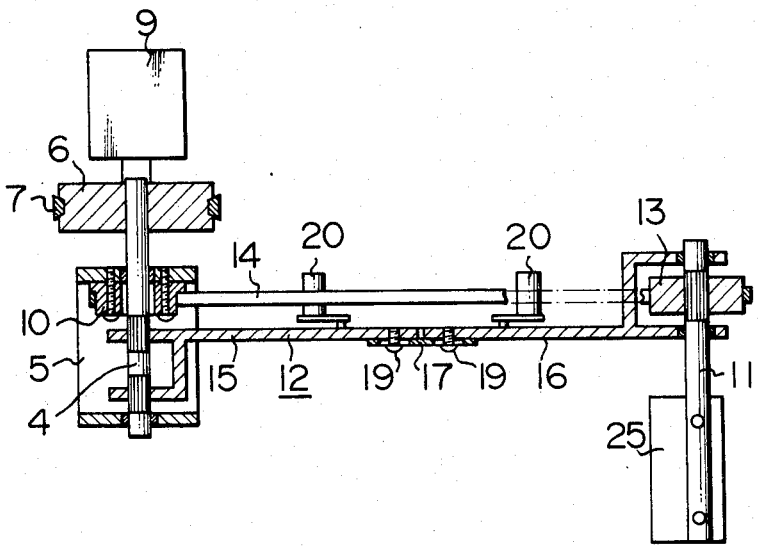
FIG. 4 is an enlarged top plan view with a part in section.

In reference to FIGS. 1 to 10, a first preferred embodiment of the present invention will be described. (1) indicates a label printer, wherein a scaling conveyor (2) and a label adhering conveyor (3) also acting as a mount block are arranged in front of the label printer (1) while both conveyors are connected to each other. Between the label printer (1) and the label adhering conveyor (3) is arranged a frame (5) for rotatably supporting a drive shaft (4). The drive shaft (4) is connected to a motor (9) through a pulley (6) having a large diameter, a belt (7) and a pulley (8) having a small diameter. To the frame (5) is fixedly screwed a fixing pulley (10) acting as a fixed pulley. There is provided an arm (12) having one end fixedly fitted to the drive shaft (4) and the other end rotatably holding a support shaft (11). To the support shaft (11) is fixedly fitted a rotary pulley (13) acting as a rotary wheel and an endless belt (14) is wound around the rotary pulley (13) and the fixed pulley (10). The arm (12) is divided into a plurality of divisional arm (15) and (16), and these divisional arms (15) and (16) are connected to each other by threadably engaging a plurality of screw (19) passed through lateral longitudinal holes (18) formed in a connector plate (17) acting as a connector with each of these divisional arms (15) and (16). Further, to the divisional arms (15) and (16) are mounted idler rollers (20) forcedly pressing against belt (14).

At a label issuing port (21) of said label printer (1) are arranged rollers (22) made of Teflon (polytetrafluoroethylene) and a solenoid (24) having a projection part (23) which projects upwardly from between these rollers (22). To said pivot shaft (11) is fixed a label adhering means (25). At the lower surface of the label adhering means (25) is formed a suction surface (26) having a suction hole (not shown) connected to a source of negative pressure (not shown) through a flexible hose (27).

Figure 5:
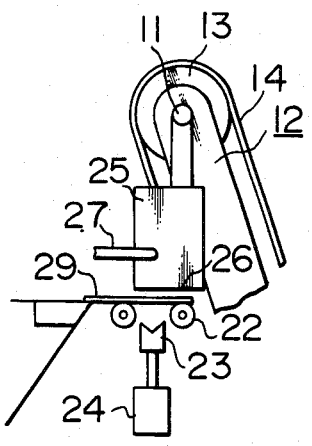
FIGS. 5 to 8 are a partial enlarged side elevational view for showing an operation starting from a suction of label to an adhering of it.
Figure 6:
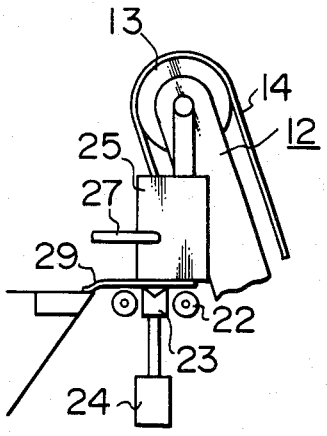
Figure 7:
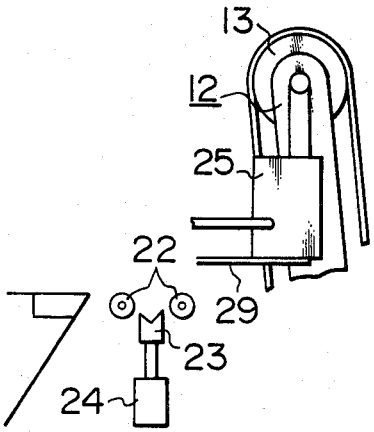
Figure 8:
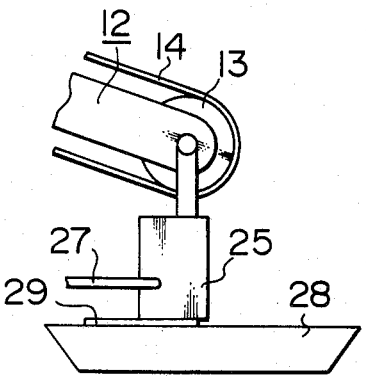

With such arrangement as above, the arm (12) is reciprocatably rotated between the label issuing port (21) and the label adhering conveyor (3) under a normal or reverse rotation of a motor (9) by a specified angle as shown in FIG. 1, In turn, the adhered object (28) is scaled on the scaling conveyor (2), a label (29) having its scaled value and price etc. printed thereon is issued from the label issuing port (21) as shown in FIG. 5 and then supported on the rollers (22). The label (29) has an adhering surface at its lower surface and no adhering of the label against the rollers (22) occurs due to their Teflon surfaces. As the label adhering means (25) is moved near the label issuing port (21), a passage between the source of negative pressure and the suction surface (26) is connected and as shown in FIG. 6 a solenoid (24) is energized to push up the label (29) with the projection part (23). Thus, the label (29) is positively suctioned against the suction surface (26) of the label adhering means (25). Then, the motor (9) is rotated in one direction to cause the arm (12) to be rotated as shown in FIG. 7 up to the label adhering conveyor (3) as shown in FIG. 8. At this time, since the fixed pulley (10) is not rotated, a rotating force is generated in the belt (14) to cause the rotary pulley (13) to be rotated by a specific angle. The fixed pulley (10) and the rotary pulley (13) have the same diameter as each other, so that the label adhering means (25) keeps the same attitude at every positions in a range of rotating movement of the arm (12), and if it is in the label issuing position, the suction surface (26) is faced downwardly to provide a positive suction of the label (29) and in turn if it is in the label adhering position, the label (29) is kept horizontal and then the label (29) is forcedly contacted against the adhered object transmitted on the label adhering conveyor (3). Therefore, the label (29) is adhered positively onto the object (28) without being flown in the air. After adhering of the label, the motor (9) is rotated in a reverse direction by a specified angle and the arm (12) repeates a rotating movement in which the arm is rotated up to the label issuing port (21).

Figure 9:
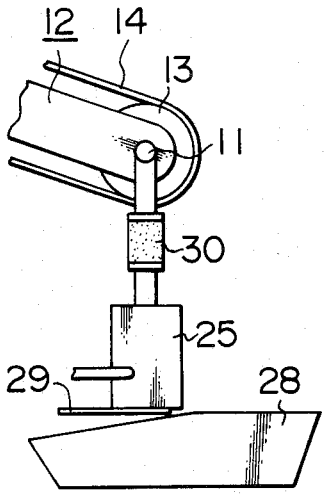
FIGS. 9 and 10 are a partial enlarged side elevational view for showing a condition where a shock absorber is arranged between a pivot axis and a labeller along with a label adhering operation.
Figure 10:
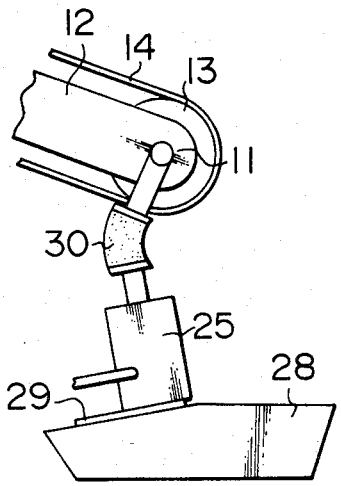

The loosening of the belt (14) is prevented by the idler rollers (20) and when the loosening may not be adjusted by the idlers (20), the screws (19) are loosened, the divisional arms (15) and (16) are slid longitudinally and then fastened by the screws (19). As shown in FIG. 9 and FIG. 10, a shock absorbing material (30) such as a cushion member, coil spring etc. is fixed to the support shaft (11) and a label adhering means (25) is fixed to a lower end of the shock absorbing means (30), thereby a lower surface of the label adhering means (25) is properly adhered to the adhered object (28) even if the degree of tensioning of the belt (14) is varied, a slight displacement in the label adhering means (25) is found and an upper surface of the adhered object (28) is inclined, and therefore the label (29) may positively be adhered.

Further it is possible to move the arm (12) between the label issuing position and the label adhering position with a simple reciprocating operation of the arm in one direction as well as to simplify the structure of the system.

In reference to FIGS. 11 to 22, a second preferred embodiment of the present invention will be described. (31) indicates a label printer and in front of the label printer (31) are connected a scaling conveyor (32) and a label adhering conveyor (33) operated as a mount block. Between the label printer (31) and the label adhering conveyor (33) is arranged a frame (35) which rotatably holds the driving shaft (34). The driving shaft (34) is connected to the motor (39) through a pulley (36) having a large diameter and a pulley (38) having a small diameter. To the frame (35) is fixed a fixed pulley (40) by screws. There is provided an arm (42) having one end fixedly fitted to the driving shaft (34) and the other end rotatably held by the support shaft (41). To the support shaft (41) is fixedly fitted a rotary pulley (43) and a belt (44) is wound around the rotary pulley (43) and the fixed pulley (40). The arm (42) is divided into a plurality of divisional arms (45) and (46) at its intermediate part and these divisional arms (45) and (46) are connected to each other through a connection plate (47) in such a way arms (45) and (46) are arranged the idler rollers (48) which are resiliently contacted to the belt (48).

Figure 15:
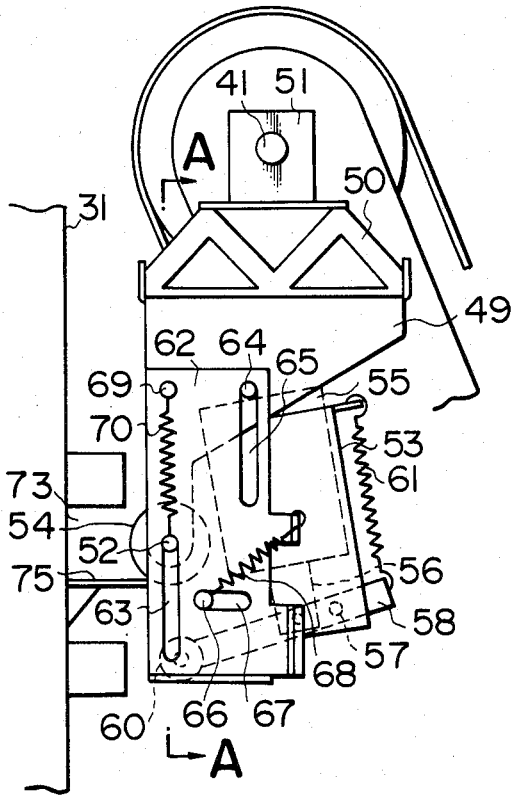
FIG. 15 is an enlarged side elevational view for showing a substantial part.
Figure 16:
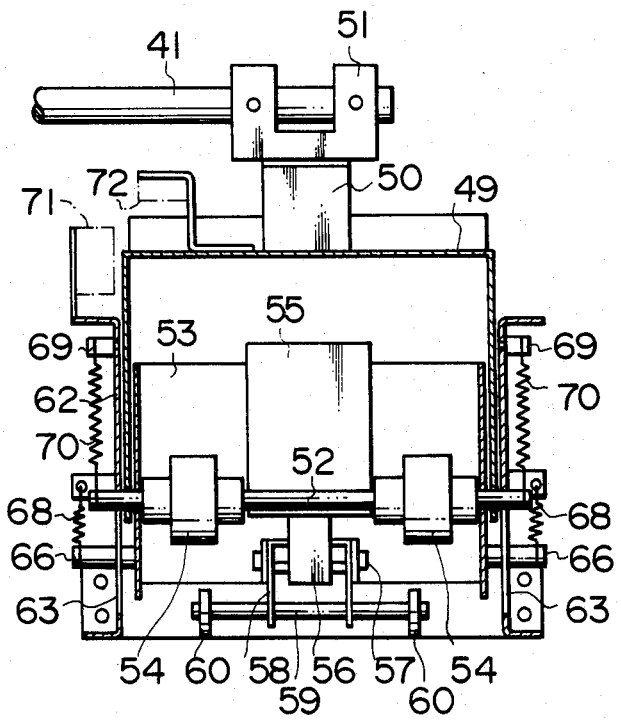
FIG. 16 is an enlarged longitudinal front elevational view in section taken along line A—A of FIG. 15.

Thus, the frame (49) is connected to one end of said support shaft (41). That is, a block (51) is fixed to the upper part of the frame (49) with the shock absorbing hollow rubber member (50) being held therebetween and the block (51) is fixedly fitted to the support shaft (41). Fulcrum point shaft (52) is arranged at both sides of the frame (49). The fulcrum point shaft (52) also acts as a rotating fulcrum point for the rotary frame (53) and further rotatably holds the frame (62). To the rotary frame (53) is fitted a solenoid (55) of an electromagnetic driving part in such a way as its vertical position may be adjusted, and to both sides of the arm (58) connected to the movable iron core (56) of the solenoid (55) and moved vertically around the pin (57) are held label holding rollers (60) through the support shaft (59). Between the end of the arm (58) and the rotary frame (53) is arranged a spring (61) for biasing the movable iron core (56) of the solenoid (55) in its returning direction. And to the frame (49) is held slide frame (62) acting as an operative means in such a way as it may be moved vertically. At both sides of the slide frame (62) are formed longitudinal guide holes (63) fitted to said fulcrum point shaft (52) projecting outside of the frame (49), longitudinal guide holes (65) similarly fitted to the guide pins (64) projecting outside of the frame (49) and the lateral longitudinal engaging holes (67) fitted to the pins (66) projecting outside of the rotary frame (53). In FIG. 15, a spring (68) is arranged between both pins (66) and the slide frame (62), thereby the rotary frame (53) is biased in a counter-clockwise direction around the fulcrum point shaft (52) and the movement of the rotary frame (53) is prevented due to a limited movement of the pins (66) against the upper edges of the engaging holes (67). That is, the slide frame (62) is always biased downwardly under an arrangement of the springs (70) stronger than said springs (68) which are arranged between the pins (69) vertically projected at both sides of the slide frame and the fulcrum point shaft (52). At one side of the slide frame (62) is held a permanent magnet (71) and the frame (49) is provided with a reed switch (72) oppositely facing against the permanent magnet (71) when the slide frame (62) is lifted up.

Figure 11:
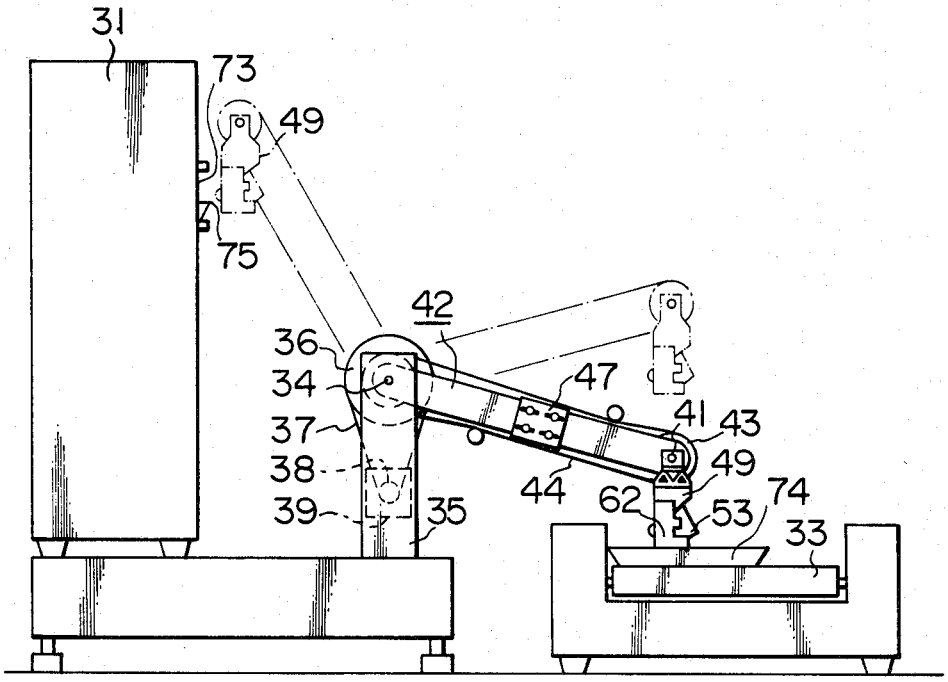
FIG. 11 is a side elevational view for showing a second preferred embodiment of the present invention.
Figure 12:
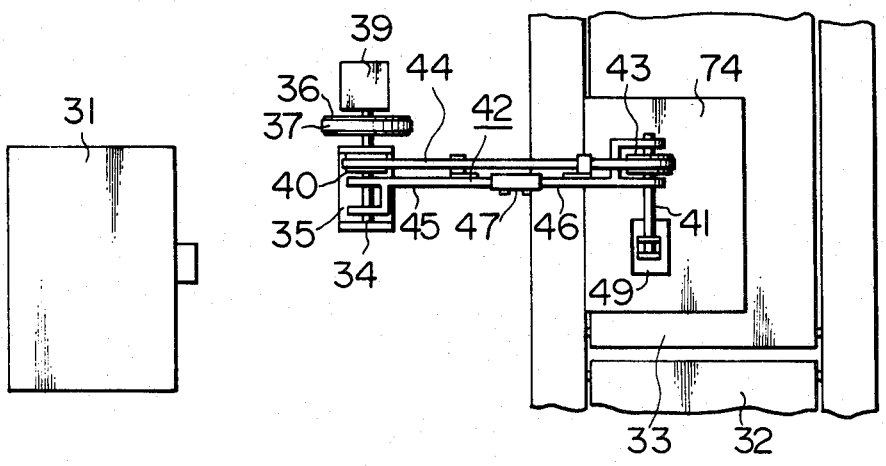
FIG. 12 is a top plan view of FIG. 11.
Figure 13:
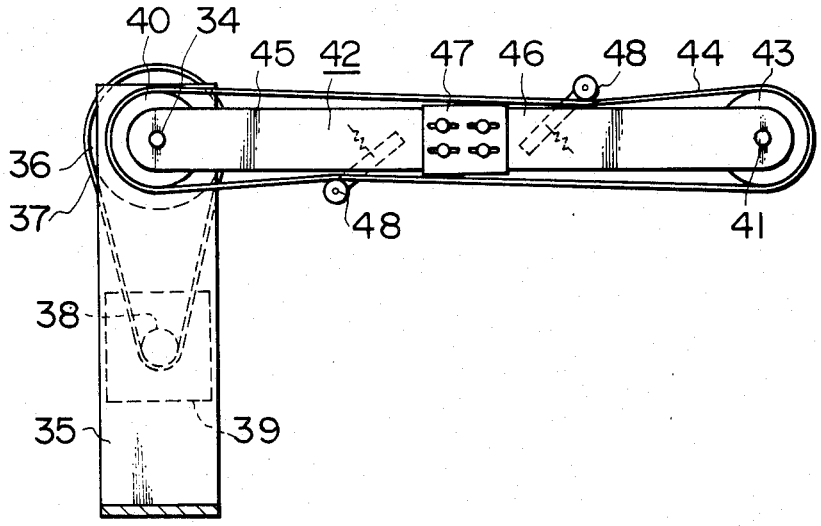
FIG. 13 is an enlarged side elevational view for showing a mechanism for rotating an arm.
Figure 14:
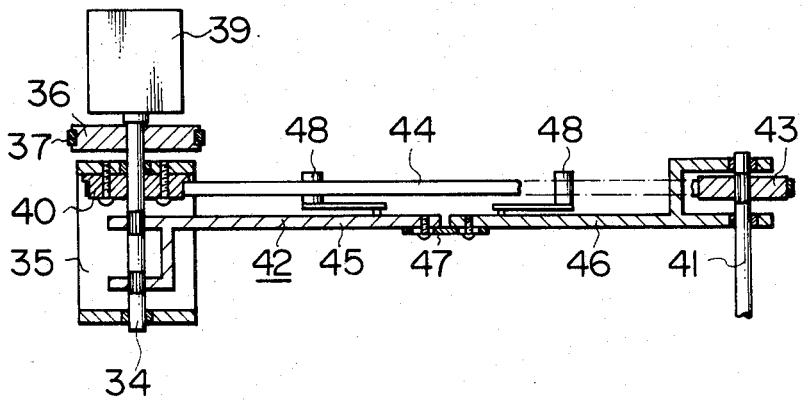
FIG. 14 is an enlarged horizontal section for showing a mechanism for rotating an arm.
Figure 17:
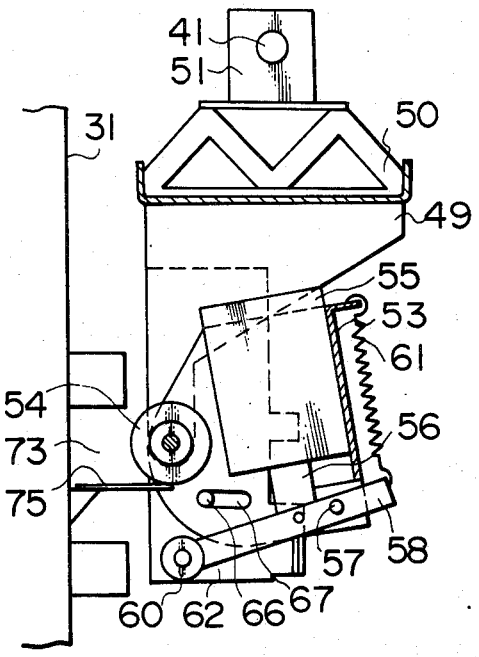
FIGS. 17 to 21 are a longitudinal side elevational view in section for showing a label adhering operation with a substantial part being enlarged.
Figure 18:
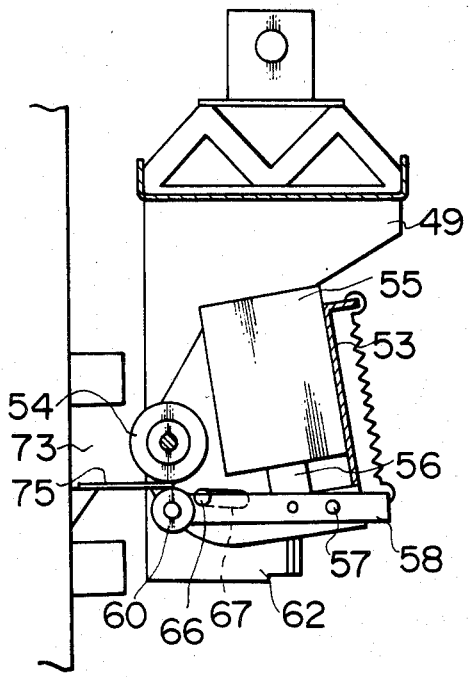
Figure 19:
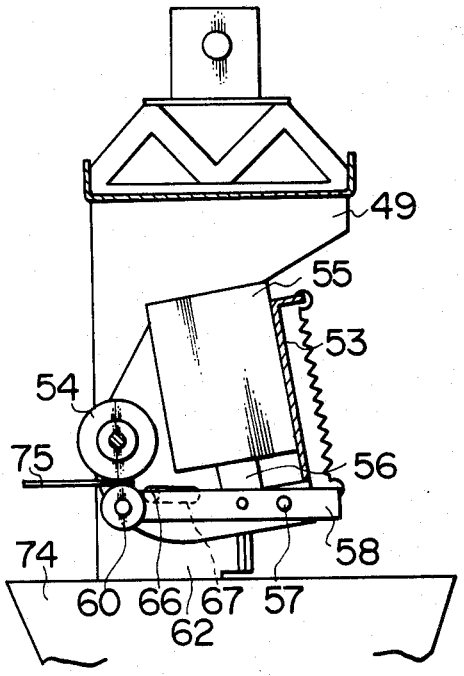
Figure 20:
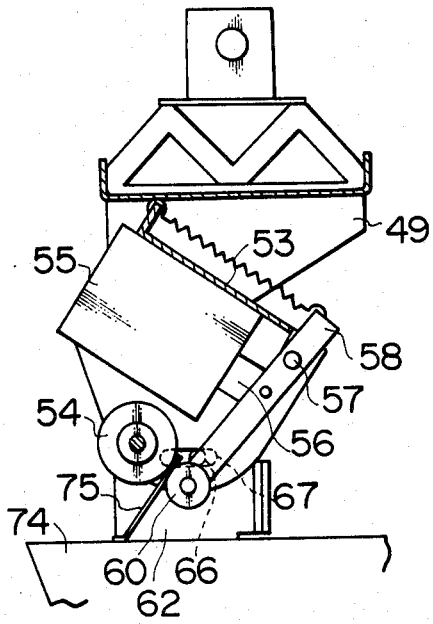
Figure 21:
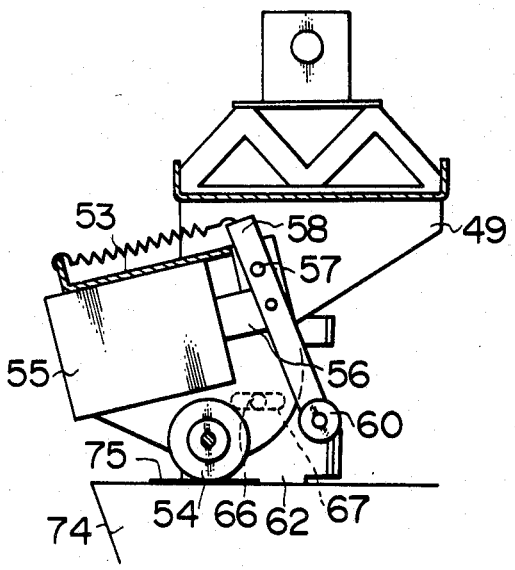

With this arrangement as above, when the motor (39) is rotated in a normal or reverse direction by a specified angle, the arm (42) is reciprocatably rotated as shown in FIG. 11 between the label issuing port (73) formed in the label printer (31) and the label adhering conveyor (33). In turn, the adhered object (74) is scaled on the scaling conveyor (32) and the label (75) having the scaled value and the price etc. printed thereon is issued from the label issuing port (73) as shown in FIGS. 15 and 17. FIG. 17 shows the condition in which the frame (49) is at the label issuing port (73) and as shown in FIG. 18, the solenoid (55) is energized in a next step and the label pressing rollers (60) are contacted to the rollers (54) so as to press the label (75). Then, the motor (39) is rotated in one direction to cause the frame (49) to be moved onto the label adhering conveyor (33) along with the arm (42). During this movement, since the fixed pulley (40) is not rotated, a rotating force is produced in the belt (44) to cause the rotary pulley (43) to be rotated by a specified angle. Since the fixed pulley (40) and the rotary pulley (43) have the same diameter, the frame (49) is kept at its vertical attitude wherever the arm (42) occupies any position in its rotating range. The label (75) may not be flown in the air due to its holding between the rollers (54) and the label pressing rollers (60) during a descending of the frame (49). And as shown in FIG. 19, the frame (49) continues a descending operation even if the slide frame (62) is contacted to the adhered object (74), so that the slide frame (62) starts to ascend resiliently against the frame (49) in respect thereto. During this process, the pin (66) is pushed up by the engaging hole (67) and the rotary frame (53) is rotated in a counter-clockwise direction around the roller (54). The rotary frame (53) is biased by a spring (68) to perform a smooth rotation. With this operation, the label pressing roller (60) is displaced sidewardly from just below the roller (54), and the label (75) is inclined from its horizontal attitude downwardly and adhered to the adhered object (74) as the frame (49)

is descended. As shown in FIG. 21, when the frame (49) is further descended down, the rollers (54) press the label (75) against the adhered object (74) to provide a positive adhering of the label (75). At this time, the slide frame (62) reaches up to the highest ascended position in respect to the frame (49), the permanent magnet (71) changes over the reed switch (72) to turn off the energization of the solenoid (55). Thereby, the label pressing rollers (60) are retracted toward the sides of the rollers (54). And then the label adhering operation is terminated, the motor (39) is rotated in a reverse direction and the arm (42) is rotated toward the label issuing port (73). As the frame (49) is moved away from the adhered object (74), the slide frame (62) is returned downwardly in respect to the frame (49) under a force of spring (70), the pin (66) is pushed downwardly with the engaging hole (67) in such a way as the label pressing rollers (60) are positioned just below the rollers (54) to cause the rotary frame (53) to be rotated in a clockwise direction.

Figure 22:
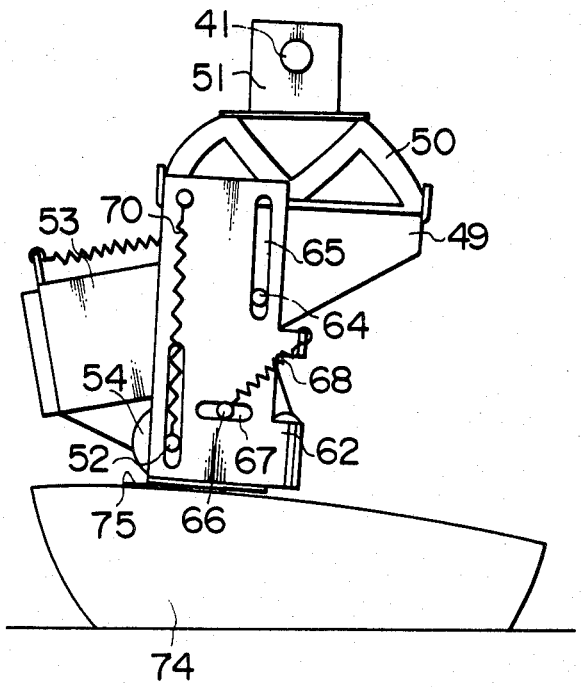
FIG. 22 is an enlarged side elevational view for showing a final step of label adhering operation.

Loosening of the belt (44) is prevented by the idler rollers (50). However, if it may not be adjusted by the idler rollers (50), the position of the divisional arms (45) and (46) may be adjusted longitudinally in respect to the connector plate (47). The frame (49) is descended with its vertical attitude and the slide frame (62) is properly contacted with the upper surface of the adhered object (74) under a flexing action of the shock absorbing rubber material (50) even if the frame is bent slightly in respect to a vertical line and the upper surface of the adhered object (74) is inclined as shown in FIG. 22.

What is claimed is:

1. Label adhering apparatus comprising:

A label printer having a label issuing port for use in issuing a label;

a mount block on which an object to be labeled is mounted;

an arm having one end rotatably held and the other end reciprocated between a label issuing position at said label issuing port and a label adhering position for said object to be labeled;

a driving shaft for reciprocatably rotating the arm;

a fixed pulley fixed to a rotary center of said arm;

a rotary pulley having the same diameter as that of the fixed pulley and rotatably arranged at said other end of said arm;

an endless belt wound around the rotary pulley and said fixed pulley so as to connect both of said pulleys; and a label adhering means fixedly connected to said rotary pulley;

the label adhering means further including:

a frame;

a pivotable frame mounted on said frame;

rollers rotatably mounted on said pivotable frame;

electromagnetic driving means mounted on said pivotable frame;

label pressing rollers connected to the electromagnetic driving means and movable to and away from a lower outer circumference of said rollers, and further rotatably connected to said frame around a lateral axis; and operative means for pivotably rotating said pivotable frame in such a direction that said label pressing rollers are displaced along an outer circumference of said rollers from below said rollers to side portions thereof in response to movement of said label adhering means toward a labeling adhering position.

2. The apparatus of claim 1 wherein said operative means comprise a slide frame slidably mounted on said frame, and means for causing pivoting of said pivotable frame in response to sliding of said slide frame.

3. A label adhering apparatus comprising:

a label printer having means for supporting a label having an adhesive on one side thereof;

means for supporting an object to be labeled;

an arm having one end pivotable about an axis fixed relative to said label printer and having another end movable between positions adjacent said label printer and said object to be labeled upon pivoting of said arm about said axis;

means for pivoting said arm;

a label adhering means pivotably mounted to said another end of said arm, said label adhering means having a holding surface including means for positively holding a non-adhesive side of said label;

means for pivoting said label adhering means during pivoting of said arm such that said holding surface extends parallel to and faces said non-adhesive side of said label when said arm is pivoted to a position adjacent said label printer for holding said label, and such that said holding surface extends parallel to and faces said object to be labeled when said arm is pivoted adjacent thereto for adhering said adhesive side of said label thereto, wherein said label adhering means lacks means for positively separating a label from said holding surface and comprises:

a frame fixed relative to said another end of said arm;

a pivotal frame mounted on said frame;

rollers mounted on said pivotable frame and comprising said holding surface;

label pressing rollers movable into contact with said rollers and comprising said means for positively holding and;

operative means for pivotably rotating said pivotable frame in such a direction that said label pressing rollers are displaced along an outer circumference of said rollers in response to movement of said label adhering means toward a label adhering position.

4. The apparatus of claim 3 wherein said means for positively holding comprise suction means.

5. The apparatus of claim 4 wherein said means for positively separating comprise gas blowing means.

6. The apparatus of claim 3 wherein said nonadhesive side of said label supported by said label printer and said object to be labeled are mutually parallel, and wherein said means for pivoting said arm and means for pivoting said label adhering means comprise:

a drive shaft extending along said axis, said arm being fixed to said drive shaft;

a fixed first pulley surrounding said axis;

a second pulley fixed to said label adhering means, said second pulley having a diameter equal to that of said first pulley; and a belt connecting said first and second pulleys.

7. The apparatus of claim 6 including idler means resiliently pressing said belt for tensioning said belt.

8. The apparatus of claim 6 including flexible shock absorbing means between said second pulley and said label adhering means.

9. The apparatus of claim 6 wherein said arm is dividing into two adjustably connected sections for adjusting the length of said arm.

10. A label adhering apparatus comprising:

a label printer having means for supporting a label having an adhesive on one side thereof;

means for supporting an object to be labeled;

an arm having one end pivotable about an axis fixed relative to said label printer and having another end movable between positions adjacent said label printer and said object to be labeled upon pivoting of said arm about said axis;

means for pivoting said arm;

a label adhering means pivotably mounted to said another end of said arm, said label adhering means having a holding surface including means for positively holding a non-adhesive side of said label;

means for pivoting said label adhering means during pivoting of said arm such that said holding surface extends parallel to and faces said non-adhesive side of said label when said arm is pivoted to a position adjacent said label printer for holding said label, and such that said holding surface extends parallel to and faces said object to be labeled when said arm is pivoted adjacent thereto for adhering said adhesive side of said label thereto, wherein said label adhering means lacks means for positively separating a label from said holding surface, and wherein said means for supporting a label on said label printer comprises a Teflon roller, further comprising a projection part movable into contact with said adhesive side of said label for pushing said label off of said roller.

11. The apparatus of claim 10 wherein said means for positively holding comprise suction means.

12. The apparatus of claim 11 wherein said means for positively separating comprise gas blowing means.

13. The apparatus of claim 10 wherein said nonadhesive side of said label supported by said label printer and said object to be labeled are mutually parallel, and wherein said means for pivoting said arm and means for pivoting said label adhering means comprise:

a dirve shaft extending along said axis, said arm being fixed to said drive shaft;

a fixed first pulley surrounding said axis;

a second pulley fixed to said label adhering means, said second pulley having a diameter equal to that of said first pulley; and a belt connecting said first and second pulleys.

14. The apparatus of claim 13 including idler means resiliently pressing said belt for tensioning said belt.

15. The apparatus of claim 13 including flexible shock absorbing means between said second pulley and said label adhering means.

16. The apparatus of claim 13 wherein said arm is dividing into two adjustably connected sections for adjusting the length of said arm.

* * * * *